United States Patent [19]

Hartmann et al.

[11] 4,093,206

[45] June 6, 1978

[54] FOLDING DEVICE FOR ROLLER ROTATING PRINTING PRESSES

[75] Inventors: Karl-Heinz Hartmann, Lambsheim; Hans-Günther Mayer, Frankenthal, both of Germany

[73] Assignee: Albert-Frankenthal AG, Frankenthal, Germany

[21] Appl. No.: 738,410

[22] Filed: Nov. 3, 1976

[30] Foreign Application Priority Data

Nov. 5, 1975 Germany ..... 2549595

[51] Int. Cl.[2] ..... B65H 45/18

[52] U.S. Cl. ..... 270/67; 270/80; 270/83

[58] Field of Search ..... 270/80–85, 270/67

[56] References Cited

FOREIGN PATENT DOCUMENTS 736,746 9/1955 United Kingdom ..... 270/80

*Primary Examiner*—Edgar S. Burr
*Assistant Examiner*—A. Heinz
*Attorney, Agent, or Firm*—Allison C. Collard

[57] ABSTRACT

Folding device for roller rotating printing presses for folding a prefolded pack of sheets which is fed by a pair of endless conveyor belts underneath a folding knife in parallel direction of its feeding movement wherein at the arriving end and on both sides of the folding knife, a finger is moved into the feeding path of the pack of sheets so as to engage an advancing front edge of the pack of sheets. The finger is forcibly moved into rotation by a shaft which runs laterally beneath the endless conveyor belts whereby the rotation moves the finger in a working cycle above the lower plane of the endless conveyor belts and the finger runs slowly in direction of the feeding motion, but more slowly than the same.

5 Claims, 3 Drawing Figures

FOLDING DEVICE FOR ROLLER ROTATING PRINTING PRESSES

BACKGROUND OF THE INVENTION

This invention relates to a folding device for use with roller rotating printing presses. More particularly, the invention is concerned with the folding of a prefolded pack of sheets.

In conventional folding devices, the prefolded pack of sheets are normally fed by a pair of endless feeding belts and are positioned underneath a folding knife in a direction parallel to its direction of feeding movement. When stationary end abutments are provided at the receiving end for the pack of sheets which do not arrive at a right angle with respect to the plane of the folding knife, it is difficult and sometimes impossible to align the pack of sheets properly due to the shortness of time. This results in an oblique or misaligned second longitudinal fold which can lead to disturbances or interferences during delivery.

It is therefore an object of invention to prevent the aforementioned disadvantages by providing a device at the end of the feed which enables the obliquely or improperly fed packs of sheets to be straightened so that a proper and an exact second longitudinal fold is assured, without slowing down the feeding speed.

SUMMARY OF THE INVENTION

In order to overcome the aforesaid problems, the present invention provides for alignment fingers to correct the improperly fed pack of prefolded sheets. The feed mechanism includes two or more pairs of overlapping endless feed belts. The pack of prefolded sheets are carried between the endless feed belts until the front edge of the pack of sheets is engaged by fingers. The fingers are positioned between adjacent pairs of the overlapping belts in a direction transverse to the direction of travel, whereby the fingers run in the engaged position with the pack of sheets. The lagging edge of the pack of sheets is caused to straighten out due to the faster movement imparted to the lagging edge by means of the faster moving pair of endless feed belts until the front edge of the pack of sheets is aligned at a right angle with respect to the folding knife. Precisely at this point the second longitudinal fold is made. Hence, the straightening of the front edge of the pack of sheets is carried out by means of the cooperation of the fingers which stop the leading edges and the endless feed belts which continue to move to bring up the lagging edges during the last phase of feeding. Thereby, the overall feeding speed stays the same.

Other objects and features of the present invention will become apparent from the following detailed description when taken in connection with the accompanying drawings which disclose one embodiment of the invention. It is to be understood that the drawings are designed for the purposes of illustration only, and are not intended as a definition of the limits and scope of the invention disclosed.

BRIEF DESCRIPTION OF THE DRAWINGS

In the drawings, wherein similar reference numerals denote similar elements throughout the several views.

DETAILED DESCRIPTION OF THE PREFERRED EMBODIMENT

Figure 1:
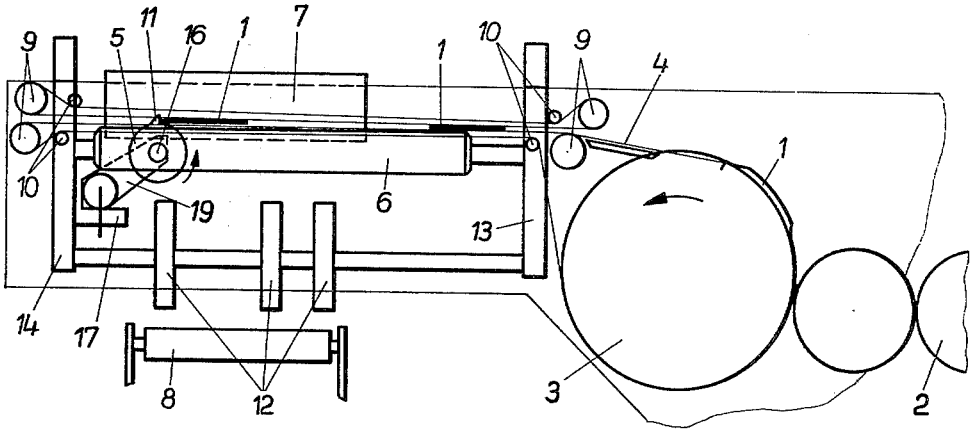
FIG. 1 is a longitudinal side view of the folding device with the direction of feed from right to left as viewed in the drawings.
Figure 2:
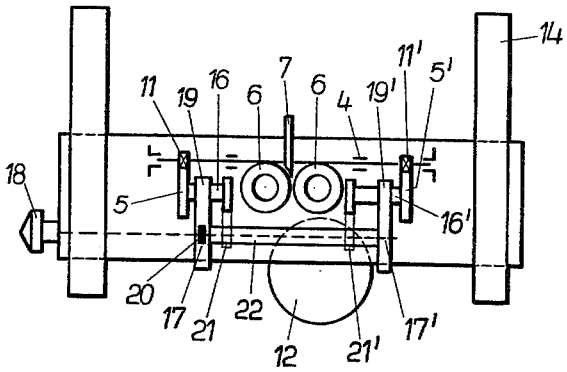
FIG. 2 is a rear view of the folding device perpendicular to the direction of feed.

In the drawings, which illustrate a preferred embodiment of the invention, a folding device having side walls 13 and 14 supports endless guide rollers 9 and 10. Two or more pairs of endless conveyor belts 4 are provided, one of which is an upper belt and the other of which is a lower belt. The lower belt is carried by a folding cylinder 3 which is adapted to receive printed webs of paper which roll off a roller rotating printing press after being cut into sheets by lateral cutter and laterally folded by folding cylinder 3.

After the sheets are cut, they are formed into a pack of sheets 1 which is delivered in the direction of the arrow between the pair of endless conveyor belts 4 and is further transported by the same, whereby the endless conveyor belts are guided by guide rollers 9 and 10. In this manner, the packs of sheets 1 are delivered into the acting range of folding knife 7 which pushes the pack of sheets between folding rollers 6 thus creating the second longitudinal fold. Folding rollers 6 are supported in side walls 13 and 14. In this condition, the pack of sheets is moved to a paddle wheel 12 which delivers the specimen to the sheet discharge which is shown in the form of a band roller 8. The folding device which is known in this configuration is mounted in side walls 13, 14 and displaceable in frames 15. The guide rollers 9 and 10 are carried in oppositely disposed frames 15.

Figure 3:
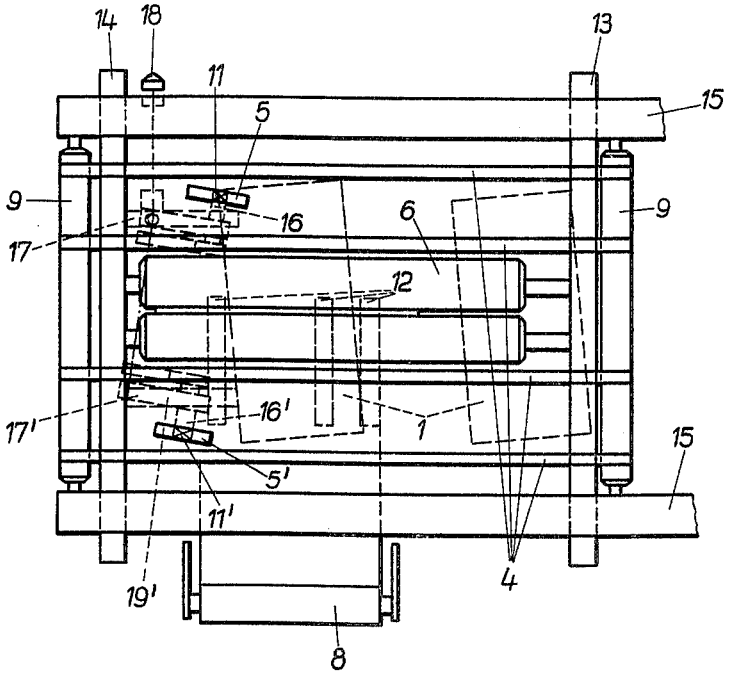
FIG. 3 is a plan view of the folding device with the direction of feed being from right to left as viewed in the drawing.

A requirement to obtain an acceptable second longitudinal fold is that the front edges of the pack of sheets 1 be fed at a right angle with respect to the folding knife. This is not always the case. In FIG. 3, it is shown that the right corner edge of the pack of sheet advances ahead of the other portions. Referring to FIG. 3, shaft 16 is connected by means of a bracket with a yoke 22 and two arms 19, 19' and commonly connected shafts 16, 16' is pivoted against the advancing front edge of pack of sheets 1, in that yoke 22 is pivoted around joint 20 on stationary console 17.

The right front edge portion of the pack of sheets engages one finger 11 and a rotating disc 5 which rotates together with shaft 16. A forcible rotating drive in the cycle of the arriving pack of sheets is provided for shaft 16 and thereby finger 11 on disc 5 by means of a joint shaft 18 and a gear on toothed belt 21, so that finger 11 emerges slightly above the plane of lower conveyor belts 4 shortly before the front edge of the pack of sheets arrives. The finger 11 moves slower between the bands 4 in the rotating direction of small arrow D, whereby the advanced front edge portion of the pack of sheets pushes against finger 11 thus slowly but constantly moving and retaining the advanced edge portion of the pack until the lagging left side of the front edge portion is aligned with the right front edge portion. When the edge portions are aligned in a rectangular plane with respect to folding knife 7, the second folding is carried out.

The second finger 11' which is mounted on a second disc 5' on shaft 16' does not operate during the aforementioned alignment procedure. This finger operates when the left front edge of the pack of sheets advances, because then yoke 22 is pivoted around joint 20 in such a manner that shaft 16 is disposed against the feeding movement.

The adjustment of pivoting yoke 22 which is mounted on two stationary consoles 17, 17' is carried out by means of a worm spindle (not shown) which is mounted on console 17'.

Instead of the shown and described adjustment of shafts 16, 16' a number of other embodiments may be employed, for example, by mounting yoke 22 on a centrally vertical rotating bolt which is rotatable and can be arrested. Naturally, the cross section of the turning cycle for fingers 11, 11' must be such that during its slower circumferential speed the speed corresponds to the higher speed of the cycle for the packs of sheets.

By means of a variable drive (not shown), or the like, in the drive pulley of shaft 16 it is possible to adjust the working cycle of finger 11 with respect to the sequence of the fed packs of sheets.

While there has been shown what is considered a preferred embodiment of the invention, it will be obvious that various changes and modifications may be made thereto without departing from the scope of the invention.

What is claimed is:

1. A folding device for roller rotating printing presses for folding a prefolded pack of sheets which are fed in a folding path between a pair of endless conveyor belts in a direction parallel to and underneath a folding knife comprising:

a frame;

a generally U-shaped yoke including a horizontally extending base member and two arms secured to, and extending upwardly from opposite ends of said base member, said yoke being pivotably mounted on said frame for pivotable movement about a vertical axis, and such that said arms thereof are disposed on opposite sides of said folding knife;

a pair of horizontally-disposed rotatable shafts each of which is coupled to the upper end of one of said arms of said yoke for rotation about a horizontal axis, said shafts being disposed beneath said belts;

a finger coupled to each of said shafts for rotation therewith, said fingers being rotatably movable into the folding path of the pack of sheets so as to engage an advancing leading edge thereof;

means for rotating said shafts so that said fingers are moved in a work cycle in the folding path of the pack of sheets so that one of the said fingers will engage an advancing leading edge thereof, said means rotating said shaft and, in turn, said fingers, in the feeding direction of the pack of sheets but at a slower speed so as to permit the trailing edge of the pack of sheets being fed at a higher speed by said belts, to become properly aligned with the leading edge; and means for pivoting said yoke so as to, in turn, move one of said fingers toward the leading edge of the pack of sheets for engagement therewith, the other finger remaining in a non-engagement position relative to the pack of sheets until such time that the trailing edge of the pack of sheets becomes properly aligned with the leading edge thereof.

2. The device according to claim 1 wherein said means for rotating said shafts includes means for varying the speed of rotation of said shafts and, in turn, the work cycle of said fingers with respect to the feeding rate of the pack of sheets.

3. The folding device according to claim 1 wherein said means for rotating said shafts includes a drive shaft and a pair of drive belts, each of which couples one of said shafts with said drive shaft and wherein said frame includes a joint in which said yoke is pivotably mounted.

4. The folding device according to claim 3 wherein said frame includes a fixed stationary console in which said joint is mounted.

5. The folding device according to claim 1 additionally including a pair of discs, each of which is coaxially mounted on one of said shafts, said fingers each being mounted on the periphery of one of said discs.

* * * * *